US005174513A

United States Patent [19]

Rose et al.

[11] Patent Number: 5,174,513

[45] Date of Patent: Dec. 29, 1992

[54] EFFICIENT CENTRIFUGAL IMPACT CRUSHER WITH DUST REMOVAL CAPABILITY

[75] Inventors: Neil M. Rose, Vancouver, Wash.; Stephen B. Ackers, Portland, Oreg.; Brett M. Rose, Battle Ground; William F. Burr, Ridgefield, both of Wash.

[73] Assignee: Canica Crushers, Inc., Vancouver, Wash.

[21] Appl. No.: 703,780

[22] Filed: May 22, 1991

[51] Int. Cl.[5] ..... B02C 13/09

[52] U.S. Cl. ..... 241/275; 241/48

[58] Field of Search ..... 241/275, 48

[56] References Cited

U.S. PATENT DOCUMENTS

| | | | |
|---|---|---|---|
| 3,204,882 | 9/1965 | Vifian et al. | 241/48 X |
| 3,652,023 | 3/1972 | Wood | 241/275 |
| 4,126,280 | 11/1978 | Burk | 241/275 |

*Primary Examiner*—Douglas D. Watts
*Attorney, Agent, or Firm*—Chernoff, Vilhauer, McCLung & Stenzel

[57] ABSTRACT

A centrifugal impact crusher has an enclosed table to ensure that substantially all the material deposited on the table is impacted against the anvils that surround the table. The table includes spaced-apart upper and lower plates that have radially oriented impellers sandwiched between them to direct material being thrown off of the table by centrifugal force to exit the table at the proper angle to achieve maximum fracture upon striking the anvils. The impellers have projecting tabs which fit into receptacles in the upper and lower plates and the plates are squeezed together to hold the tabs in the receptacles and lock the plates and impellers together in a rigid table assembly. The upper plate has a central opening through which material is deposited onto the table. A funnel directs material fed into the crusher through an infeed plenum and into the central opening in the upper plate to ensure that all of the material reaches the table. Recirculation plenums extend from an outlet plenum located below the table up to the infeed plenum. The rotating table acts as a fan which draws air into the infeed tube along with the material, and this airflow creates a pressure differential across the table that causes air to flow through the recirculation plenum. The recirculation air includes dust and particulate matter which is either sent back through the crusher to be more finely crushed or is removed by filters.

12 Claims, 3 Drawing Sheets

EFFICIENT CENTRIFUGAL IMPACT CRUSHER WITH DUST REMOVAL CAPABILITY

BACKGROUND AND SUMMARY OF THE INVENTION

This invention relates to a centrifugal impact crusher, and in particular to such a crusher in which 100% of the material fed into the crusher is impacted against the crushing anvils and in which the amount of dust is significantly reduced.

Centrifugal impact crushers have successfully been used for crushing a wide range of materials. A use that has recently been suggested for centrifugal impact crushers is in the production of cement. Cement has traditionally been ground from clinker in ball mills using a two-step process. The clinker is first rough ground in a first section of the ball mill having large balls, and the ground material from the first section is then reground in a second section having smaller balls. When ball mills are used to grind large particles, such as occur with clinker, they consume excessive amounts of energy, and thus they are not well-suited for this purpose. German patent DE3815217 suggests using a centrifugal impact crusher for the first section in crushing clinker, since centrifugal impact crushers handle material of this size much more efficiently than ball mills. However, the smaller second stage ball mill required to grind fine enough to produce cement does not handle large material well and the first stage device must reduce all of the material passing through it in the required amount. Prior art centrifugal impact crushers were designed to crush materials such as rock where a wide size range of crushed material is not only allowable, but actually desired. A substantial amount of material deposited onto the rotating table of prior art centrifugal impact crushers does not even strike the crushing anvils and thus is uncrushed. This means that when centrifugal impact crushers are used for the first stage of clinker reduction, the material must be sorted and a portion of it reground which increases the cost of using centrifugal impact crushers for clinker. Furthermore, cement creates tremendous amounts of dust when it is crushed in the violent manner that exists in a centrifugal impact crusher, and this dust creates significant problems.

While complete reduction and dust handling are critical when crushing clinker, dust creates problems when other materials are crushed as well. In many materials dust is handled by wetting the material. While wetting is obviously unworkable with cement, water makes sorting of other materials more difficult and it increases wear. In addition, when rock is crushed to sand, it is important that dust be separated from the sand and this cannot be done when the material is wetted during crushing.

The foregoing shortcomings and limitations of prior art centrifugal impact crushers are overcome in the subject invention by providing a table having spaced-apart upper and lower plates that have impeller blades sandwiched between them. The upper plate has a central opening through which material is deposited onto the table. Thus, the table is enclosed which forces substantially all of the material thrown off of it by centrifugal force to be impacted against the anvils. In addition, an annular retainer plate fits above the anvils and extends radially inward to the periphery of the upper plate. The retainer plate covers what little area there is for material that is thrown off of the enclosed table to miss the anvils.

The impellers have tabs protruding from their upper and lower surfaces which fit in conforming receptacles located in the upper and lower plates. The upper and lower plates are joined to one another by bolts or pins, and when the bolts are tightened or wedges inserted into the pins the tabs are seated in the receptacles and the plates and impellers form a rigid table assembly. The tabs cover a substantial portion of the impellers and, as a result, impeller attachment is spread over a large surface area which prevents the impeller connector breakage that is common with devices of this type due to the centrifugal force created by the high rotational speed and due to material striking the impellers.

In order to reduce dust and ensure uniform fine crushing, recirculation plenums extend from an outlet plenum at the bottom of the crusher shell to an infeed plenum through which material is fed into the crusher. The rotating table in the crusher acts as a fan which creates a negative pressure above the table and a positive pressure below the table. This pressure differential between the infeed plenum above the table and the outlet plenum below the table draws air into the recirculation plenums. Since the recirculation plenums receive air from beneath the table, dust and particulate matter resulting from the crushing is entrained in the air and this material passes through the recirculation plenums and back into the crusher. The recirculation plenums have outlets in them which permit particle-laden air to be removed from the plenums and the particles removed by filters or separators if desired. A flow restrictor located above the infeed plenum restricts the air that enters the crusher with the material in order to establish significant flow through the recirculation plenums. The infeed plenum is connected to the central opening in the upper plate of the table so that all of the material and dust-laden air in the infeed plenum reaches the table.

Accordingly, it is a principal object of the subject invention to provide a centrifugal impact crusher in which 100% of the material deposited in the device is thrown off of the table and impacted against the crushing anvils.

It is a further object of the subject invention to provide such a device in which the table is enclosed.

It is a still further object of the subject invention to provide such a device having a retaining plate over the anvils which prevents material from passing over them.

It is a still further object of the subject invention to provide a centrifugal impact crusher having an air recirculation system that recirculates air and entrained particles from the bottom of the crusher back into the infeed plenum.

It is a yet further object of the subject invention to provide such a crusher in which the air and entrained particles in the recirculation system can be filtered to remove the particles.

The foregoing and other objectives, features and advantages of the present invention will be more readily understood upon consideration of the following detailed description of the invention taken in conjunction with the accompanying drawings.

DETAILED DESCRIPTION OF A PREFERRED EMBODIMENT

Figure 1:
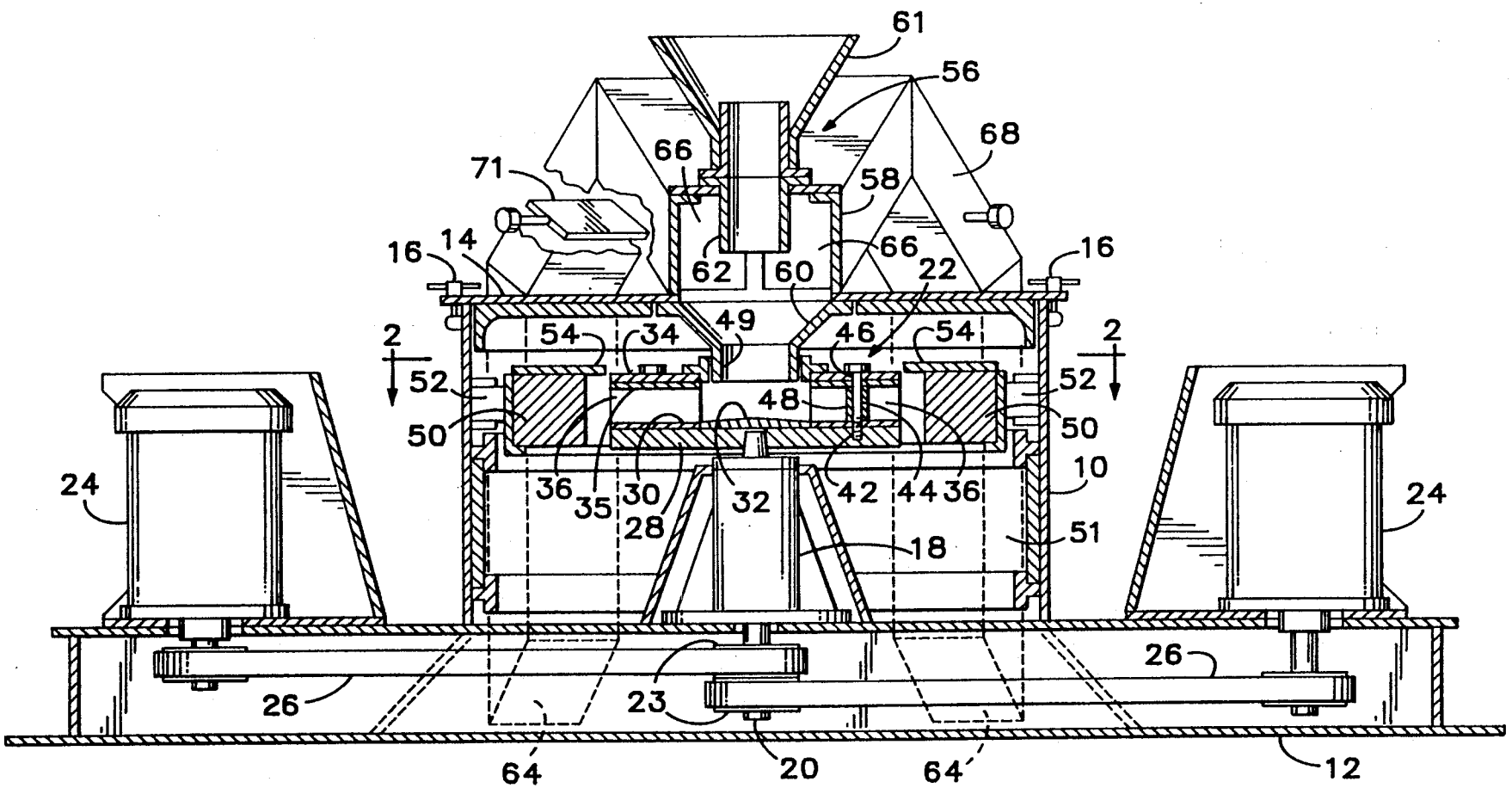
FIG. 1 is a side elevation view, in cross section, of a centrifugal impact rock crusher embodying the features of the subject invention.

Referring to FIG. 1 of the drawings, a crusher comprises a cylindrical shell 10 that is mounted on a rectangular frame 12. The shell is covered by a lid 14 that is releasably secured to the shell by means of locks 16. Located medially in the shell is a pedestal 18 that rotatably journals a shaft 20 having a table assembly 22 mounted on its upper end. The lower end of the shaft 20 carries a pair of pulleys 23 that are driven by electric motors 24 through belts 26. The table assembly 22 includes a flat circular lower plate 28 that is attached to the shaft 20 and is covered with a replaceable wear-resistant liner 30. The center section of the liner is in the shape of a cone 32. An upper plate 34 is attached to the lower plate and a plurality of radially oriented impellers 36 are sandwiched between them. The lower surface of the upper plate is covered with a replaceable wear-resistant liner 35.

Figure 2:
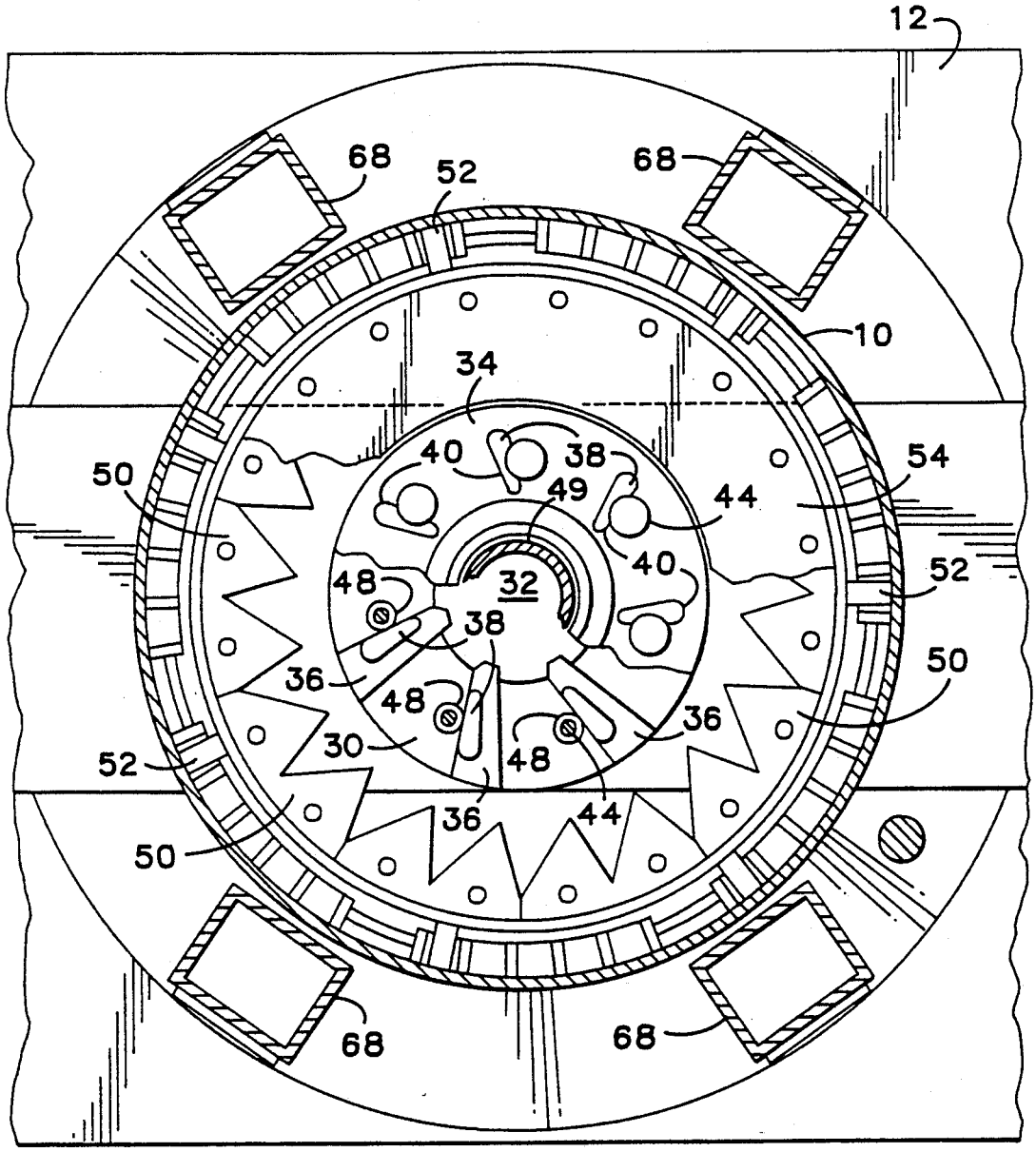
FIG. 2 is a sectional view taken along the line 2—2 in FIG. 1, partially broken away to show hidden detail.
Figure 4:
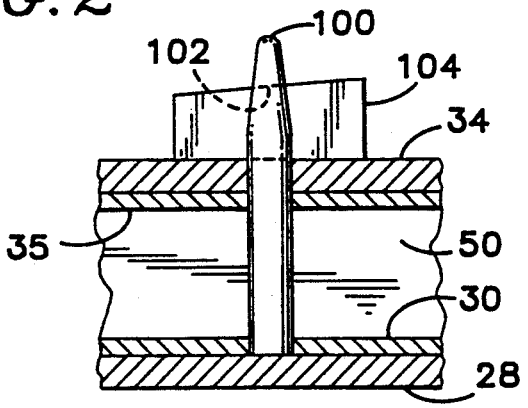
FIG. 4 is a detail view of an alternate embodiment of a portion of the crusher.
Figure 3:
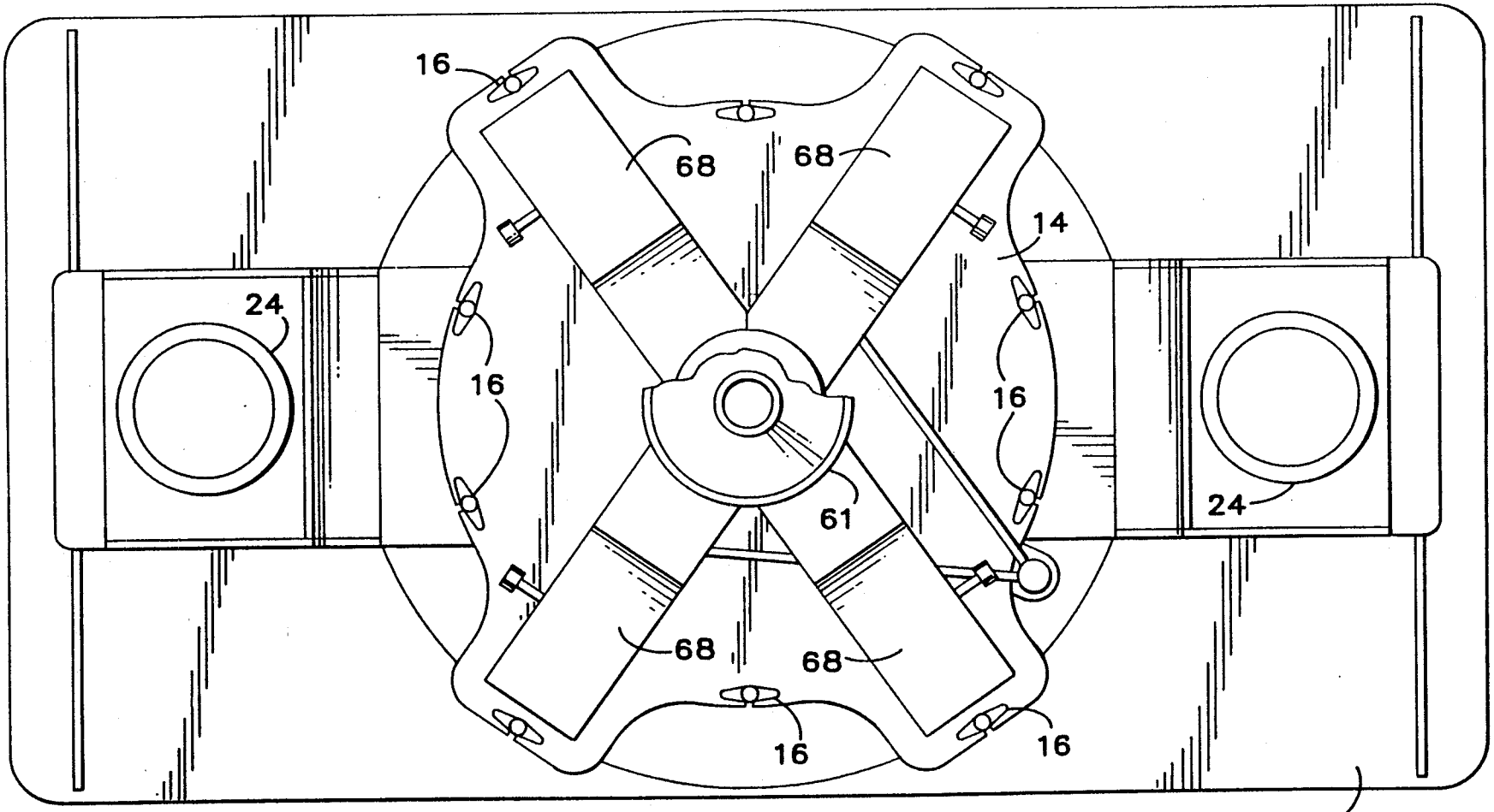
FIG. 3 is a plan view of the crusher of FIG. 1.

Referring now also to FIG. 2, the impellers 36 have tabs 38 protruding from their top and bottom surfaces, and the top and bottom plates have receptacles 40 in them which matingly receive the tabs. In one embodiment, shown in FIG. 1, the lower plate has threaded openings 42 located in it that receive bolts 44 that extend through aligned openings 46 in the upper plate. Thus, when the bolts are tightened, the plates are pulled together and the impellers are secured between them. In another embodiment, shown in FIG. 4, the bolts are replaced with pins 100 having slots 102 at their extremities and the nuts are replaced by wedges 104. The tabs constitute a relatively large percentage of the impellers thereby creating a strong bond between the impellers and plates that will not easily break during operation of the crusher, even when it is operated at high rates of speed and large forces act on the impellers. In order to protect the portions of the bolts or pins that are exposed between the plates, they are covered by replaceable wear-resistant shields 48. The upper plate 34 has a central opening 49 through which material is deposited onto the lower plate 28.

Located around the periphery of the shell 10, coplanar with the table assembly, are a plurality of anvils 50 that material thrown off of the table assembly by centrifugal force is impacted against. The fractured material drops between the periphery of the table assembly 22 and the anvils into an outlet plenum 51 provided in the shell below the table assembly. Appropriate removal devices (not shown) remove the crushed material from the outlet plenum and out of the crusher. The anvils 50 and their mounting system 52 are conventional for centrifugal impact crushers. Mounted above the anvils is an annular retainer ring 54 that extends inwardly to approximately the outer periphery of the upper plate 34.

Material is fed into the crusher through an infeed assembly 56 that is mounted on the lid 14. The infeed assembly includes a hollow cylindrical tube 58 that is attached to the lid and forms an infeed plenum 59. A funnel 60 extends from the bottom of the tube 58 into the opening 49 in the upper plate 34. Thus, all of the material passing through the infeed plenum 59 is directed into the table assembly. A hopper 61, located at the top of the crusher is connected to the tube 58 through a flow restrictor 62, whose purpose will be described later.

Located around the bottom of the shell 10 is a set of openings 64 that open into the outlet plenum 51. A matching set of openings 66 located around the periphery of the tube 58 open into the infeed plenum 59. Each opening 64 is connected to a mating opening 66 through a recirculation plenum 68. A covered outlet 70 is located in each recirculation plenum to permit a filtering system (not shown) to be connected to the plenums. An adjustable damper 71 is located in each recirculation plenum downstream of the outlet 70.

The crusher of the subject invention is operated like other centrifugal impact crushers, however, for several reasons provides improved performance. First, the enclosed table assembly 22 causes substantially all of the material deposited on it to be thrown radially outward such that it impacts the anvils 50 and becomes crushed. The retainer plate 54 covers the only area where material thrown off of the table could escape impacting the anvils, so that 100% of the material deposited on the table is crushed. In addition, the close connection between the infeed tube 58 and the upper plate 34 of the table assembly, created by the funnel 60, ensures that all material deposited in the hopper 61 at the top of the crusher is deposited on the table. Furthermore, the enclosed table assembly and close connection between the infeed tube and the table significantly reduces dispersion of the dust that is generated during crushing.

A much larger factor in the reduction of dust is the recirculation plenums 68. The rotating table assembly acts as a fan to draw air into the hopper 61 along with the material being crushed. Thus, a negative pressure is created above the table in the infeed plenum 59 and a positive pressure is created below the table in the outlet plenum 51. This pressure difference causes air to flow through the recirculation plenums 68 from the outlet plenum back into the infeed plenum. The flow restrictor 62 accelerates the air passing through the infeed plenum to create a venturi effect which increases the amount of air that flows through the recirculation plenums. Since the recirculated air has dust and particulate matter entrained in it, this material is passed back through the crusher where it is crushed to a greater degree. If filters or separators are attached to the outlets 70, dust can be removed from all or a portion of the air entering the recirculation plenum. The relative amount of the recirculation air that is filtered depends upon the setting of the dampeners 71.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A centrifugal impact rock crusher of the type having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof, and an outlet plenum defined in the chamber below the table, said crusher comprising:

(a) air removal means for removing air and airborne particles from the outlet plenum;

(b) means for recycling air and particles removed by said air removal means back into the infeed plenum; and (c) filter means for receiving at least a portion of the air and particles removed by said air removal means and removing particles therefrom.

2. A centrifugal impact rock crusher of the type having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof, and an outlet plenum defined in the chamber below the table, said crusher comprising:

(a) air removal means for removing air and airborne particles from the outlet plenum, said air removal means comprising one or more recirculation plenums that extend between the outlet plenum and the infeed plenum;

(b) a flow restrictor located in the infeed plenum upstream of said recirculation plenums.

3. A centrifugal impact rock crusher of the type having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof, and an outlet plenum defined in the chamber below the table, said crusher comprising:

(a) air removal means for removing air and airborne particles from the outlet plenum, said air removal means including one or more recirculation plenums that extend between the outlet plenum and the infeed plenum;

(b) a flow restrictor located in the infeed plenum upstream of said recirculation plenums; wherein (c) said recirculation plenums include outlets for connecting filters thereto.

4. A centrifugal impact rock crusher of the type having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof, and an outlet plenum defined in the chamber below the table, said crusher comprising:

(a) air removal means for removing air and airborne particles from the outlet plenum; wherein (b) the table includes:

(i) a lower plate;

(ii) an upper plate that overlies said lower plate and defines a central opening that communicates with the infeed plenum;

(iii) upwardly and downwardly projecting tabs on said impellers, said upper and lower plates defining receptacles for receiving said tabs; and (iv) clamp means for urging said upper and lower plates toward one another with said impellers located therebetween and said tabs received in said receptacles to create an integral enclosed table assembly.

5. A centrifugal impact rock crusher of the type having an enclosed chamber, an infeed plenum that opens into the chamber, a rotating table having a series of radially arrayed impeller blades on its upper surface located in the chamber below said infeed plenum, a plurality of anvils located in the chamber around the periphery of the table substantially coplanar with the upper surface thereof, and an outlet plenum defined in the chamber below the table, said crusher comprising:

(a) air removal means for removing air and airborne particles from the outlet plenum; wherein (b) the table includes (i) a lower plate;

(ii) an upper plate that overlies said lower plate and defines a central openings that communicates with the infeed plenum;

(iii) means for sandwiching the impellers between said upper and lower plates and creating an integral enclosed table assembly; (iv) an annular retainer plate that extends between an outer periphery of said upper plate and the anvils.

6. An table assembly for a centrifugal impact crusher of the type having an infeed tube, a rotating table located centrally below the infeed tube and having a series of radially arrayed impeller blades located on the upper surface thereof, and a plurality of anvils located around the periphery of the table substantially coplanar with the upper surface thereof, said table assembly comprising:

(a) a lower plate;

(b) an upper plate that overlies said lower plate and defines a central opening the receives the infeed tube;

(c) mans for sandwiching the impellers between said upper and lower plates and creating an integral enclosed table assembly, said sandwiching means including:

(i) upwardly and downwardly projecting tabs on said impellers;

(ii) said upper and lower plates defining receptacles for receiving said tabs;

(iii) said upper plate having a plurality of openings defined therein;

(iv) said lower plate having a plurality of pins extending upwardly therefrom, one of said pins extending through each of said openings;

(v) each of said pins having a slot defined therein proximate its upper extremity; and (vi) wedges which pass through said slots.

7. The crusher of claim 3 wherein said recirculation plenums include adjustable flow control dampers downstream of said outlets.

8. The crusher of claim 4 wherein said clamp means comprises:

(a) said lower plate having a plurality of threaded holes defined therein;

(b) said upper plate having a plurality of openings defined therein with one of said openings being aligned with each of said holes; and (c) threaded fasteners that extend through said openings and into threaded engagement with said holes.

9. The crusher of claim 8, including wear-resistant shields that surround any portion of said fasteners that are exposed between said upper and lower plates.

10. The crusher of claim 4 wherein said clamp means comprises:

(a) said upper plate having a plurality of openings defined therein;

(b) said lower plate having a plurality of pins extending upwardly therefrom, one of said pins extending through each of said openings;

(c) each of said pins having a slot defined therein proximate its upper extremity; and (d) wedges which pass through said slots.

11. The crusher of claim 10, including wear resistant shields that surround any portion of said pins that are exposed between said upper and lower plates.

12. The table assembly of claim 6, including wear resistant shields that surround any portion of said pins that are exposed between said upper and lower plates.

* * * * *

UNITED STATES PATENT AND TRADEMARK OFFICE

CERTIFICATE OF CORRECTION

PATENT NO. : 5,174,513

DATED : December 29, 1992

INVENTOR(S) : Neil M. Rose, et al.

It is certified that error appears in the above-identified patent and that said Letters Patent is hereby corrected as shown below:

Column 6 Line 28: delete "An" insert --A-- before table

Column 6 Line 38: delete "the" (first occurence) insert --that--

Column 6 Line 40: delete "mans" insert --means--

Signed and Sealed this

Twenty-third Day of November, 1993

*Attest:*

*Attesting Officer*

BRUCE LEHMAN

*Commissioner of Patents and Trademarks*